United States Patent [19]

Orita et al.

[11] Patent Number: 4,654,051

[45] Date of Patent: Mar. 31, 1987

[54] GRINDING WHEEL

[75] Inventors: Keiichi Orita; Akira Yamashita, both of Tokyo, Japan

[73] Assignee: Tohoku Chemical Industries, Ltd., Sendai, Japan

[21] Appl. No.: 782,695

[22] Filed: Oct. 1, 1985

[30] Foreign Application Priority Data

Oct. 26, 1984 [JP] Japan ..... 59-225200

[51] Int. Cl.[4] ..... C09K 3/14

[52] U.S. Cl. ..... 51/298; 528/1; 528/3

[58] Field of Search ..... 51/298; 528/1, 3

[56] References Cited

U.S. PATENT DOCUMENTS

| | | | |
|---|---|---|---|
| 2,164,326 | 7/1939 | Harvey | 528/165 |
| 2,165,140 | 7/1939 | Harvey | 528/3 |
| 2,637,709 | 5/1953 | Harvey | 528/111.5 |
| 2,985,622 | 5/1961 | Leppert | 528/1 |
| 3,966,670 | 6/1976 | Grazen et al. | 525/489 |
| 4,098,765 | 7/1978 | Kays et al. | 528/1 |

FOREIGN PATENT DOCUMENTS 34434 9/1979 Japan .

*Primary Examiner*—Paul Lieberman
*Assistant Examiner*—Willie J. Thompson
*Attorney, Agent, or Firm*—Stevens, Davis, Miller & Mosher

[57] ABSTRACT

Grinding wheel having a bonding agent for binding abrasive grains, comprising a reaction product of a synthetic resin and cashew nut sheel liquid or its derivatives. The bonding agent may include a surface active agent.

8 Claims, No Drawings

GRINDING WHEEL

BACKGROUND OF THE INVENTION

1. Field of the Invention

The present invention relates to a grinding wheel for mirror finishing, and especially, to a grindstone containing fine abrasives for finishing optical glass, semiconductor substrates or the like.

2. Prior Art

Processes for machining a surface of work to a mirror finish generally include honing, super-finishing, lapping, grinding with coated abrasives, polishing, buffing and so on. Honing and super-finishing use a grinding wheel similar to a normal grinding wheel, but are superior in working efficiency. The reason is as follows: Sharp grinding is always conducted due to fracture of abrasive grain which comes from the high speed of vibration of the grinding wheel and the frequent changes of the directions of these vibrations. Also, the efficiency of the honing operation depends upon the performance of sharp grinding due to fracture of abrasive grain. Lapping is a finishing process for the surface of the work to be machined as a cutting tool, which is used for highly accurate dimension and fine surface. The grinding process with the coated abrasive aims only for finishing the surface of the work to be machined without questioning accuracy of dimensions.

As mentioned above, on the machining in which high accuracy of finishing is required, for example, surface finishing for lenses of cameras, microscopes, etc., lapping is the process of choice. However, this process has its drawback in taking much time in lapping. The finishing process by grinding wheel is superior in operationability, but its abrasive performance depends on filling ratio of abrasive grain. Accordingly, it has been required to raise the filling ratio of abrasives grain so as to improve the abrasive performance. However there is a practical limit in obtaining the filling ratio of abrasive grains due to the problem of bonding force between the abrasive grains to each other. And therefore, the filling ratio of abrasive grains has been 90% at the most, in practice, thus there is a limit in abrasive performance.

SUMMARY OF THE INVENTION

The present invention provides a grinding wheel in which the filling ratio of abrasives grain is raised by the improvement of a bonding agent which is able to obtain high accurate mirror finishing in a short period of time.

A object of the present invention is to provide a grinding wheel which improves the abrasive performance so that machining accuracy and the function of the coolant is strengthened, and long span of the life can be enjoyed.

A further object of the present invention is to provide a grinding wheel which can obtain excellent mechanical strength and abrasive performance by raising the filling ratio of abrasives grain to more than 90%.

DETAILED DESCRIPTION OF THE INVENTION

The present invention relates to a grinding wheel characterized in that in the structure of a bonding agent which bonds abrasive grains is the reaction product of a resin and a solution of cashew nut shell liquid or its derivative and which may also contain a surface active agent.

Cashew nut shell liquid used in the present invention is a liquid similar to rhus lacquers (Japanese lacquers) contained in the outer shell of a nut of cashew which is obtained from a kind of tropical plant.

Its main ingredient comprises a mixture of Cardanol

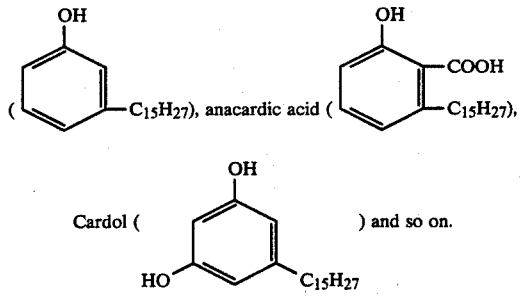

Cashew nut shell liquid or its derivative is reacted with a resin of synthetic resin-bonding agent to prepare a cashew modified resin reaction product. The synthetic resin-bonding agent containing this reaction product is mixed with abrasive grains and, optionally, a small amount of surface active agent. The mixture is heated and pressurized according to the normal method to manufacture a formed product, thus obtaining the grinding wheel of the present invention.

As the resin, i.e., bonding agent which is reacted with cashew nut shell liquid or its derivative, thermosetting resins such as phenol resins, epoxy resins, unsaturated polyester resins, etc. and thermoplastic resin such as polyamide resin, polyolefin resin, vinyl chloride resin, etc. can be used. Abrasive grains which can be used in the present invention do not receive any limitation at all. Depending on the purpose, abrasive grains, such as metallic oxide having high melting points such as cerium oxide, magnesium oxide, chromium oxide; abrasives grain such as cubic crystalline boron nitride; diamond, alumina, sapphire, silicon carbide, boron carbide, silicon nitride, etc. can be used.

In the present invention, the surface active agent is mainly used to give wettability to the surface of an abrasive grinding wheel which receives a supply of grinding fluids at the time of the grinding operation. The cashew-modified resin prepared by reacting cashew nut shell liquid or its derivative with resins of a synthetic resin bonding agent repels water. However, by adding a small amount of surface active agent to the structure of an abrasive grinding wheel, the interfacial tension between solids and liquids is reduced; and by emulsifying, wettable and permeable actions contained therein, liquid film is not discontinued between the abrasive grinding wheel and the work to be finished, thereby hightening griding and abrading operationality and cleaning force as well as preventing attritious wear of the abrasive grains in a short time.

The surface active agents used here are not restricted to any one. For example, sodium alkylsulfonic acid, sodium salt of higher alcohol sulfo-acid ester, and others may be used. The surface-active agent is added in amounts within the range in which the mechanical strength of an abrasive grinding wheel is not damaged.

The present inventors have found that an abrasive grinding wheel having a bonding agent containing cashew modified resin improves its abrasive performance in relation to an increase in the amount of cashew nut shell liquid (amount of cashew modification), and they have recognized that it is possible to increase the filling ratio of abrasives grain to 98% in case the amount of the bonding agent is constant. In comparison with the conventional method which does not employ a cashew nut liquid grinding wheel, grinding required about 45 minutes to obtain a finished surface of Rmax (Å) 600 in surface roughness of a finished surface from crystalized glass (Rmax 1000 Å) of surface roughness. A finished surface of 100 Å can be obtained in about three minutes in case of an abrasive grinding wheel in which 2.4% of cashew nut shell liquid is contained, under the same condition.

EXAMPLES

Examples of the present invention are shown below.

A grinding wheel is formed under the following conditions by bonding powder of cerium oxide (2 $\mu^{\Phi}$) with a bonding agent which is a reaction product of phenol resin containing phenol novolac and a reaction product with cashew nut shell liquid (cashew modified phenol).

Forming Condition:

1. Mixing ratio between abrasive grains and a bonding agent

Powder of cerium oxide . . . 96 wt%

Bonding agent containing cashew modified phenol resin . . . 4 wt%

2. Additive ratio (weight %) of cashew nut shell liquid against phenol novolac (phenol novolac: cashew nut shell liquid)

100:0 (Comparative Example)

90:10 (Example 1)

80:20 (Example 2)

60:40 (Example 3)

40:60 (Example 4)

3. Form-machining

Press forming

Forming temperature: 150° C.

Pressure: 200 kg/cm$^2$

Forming time: 10 minutes.

4. Shape and Dimension of the formed product 150 mm$^{\Phi}$×10 mm

On the surface to be grinded was formed V-shaped grooves each being 3 mm in depth at the intervals of 8m/m.

By using the formed products prepared by respective Examples 1 to 4 and the Comparative Example, the grinding operation was carried out under the following conditions and the ground products were subjected to the property tests.

Test Conditions (1) Grinding machine: Oscar-type machine (2) Number of rotations of grinding wheel per minute: 500 rpm (3) Load: 1 kg/cm$^2$ (4) Tommy amplitude: 15 mm×122 s.p.m.

(5) Material to be ground: Crystalized glass (surface roughness:Rmax 1,000 Å)

(6) Concentration of slurry: Water: 100 gr/5 liters

The result of the tests are shown in Tabe 1.

TABLE 1

| | Comparative Example | Example 1 | Example 2 | Example 3 | Example 4 |
|---|---|---|---|---|---|
| Filling ratio of cashew* in grindwheel (%) | 0 | 0.4 | 0.8 | 1.6 | 2.4 |
| Hardness of grindwheel | Very hard | hard | normal | soft | Very soft |
| Time required for grinding mirror (min.) | 45 | 20 | 10 | 4 | 3 |
| Surface roughness of finished surface (Rmax Å) | 600 | 300 | 200 | 150 | 100 |
| V-grooving machinability | cracked | little cracked | not so much cracked | not cracked | not cracked |

Note

*Cashew nut shell liquid

According to Table 1, within 4 wt% of the bonding agent, grinding performance was raised as the additive amount of a solution of cashew nut shell liquid (amount of cashew modification) increased. In the Comparative Example, it took 45 minutes to obtain a finished face of Rmax (Å) 600 in surface roughness of the finished face. In Example 1, on the other hand, it took only 3 minutes to obtain the finished face of 100 Å.

Nevertheless, the amount of cashew nuts shell liquid should not increase limitlessly because there is naturally a limit in obtaining increased bonding strength from a bonding agent. Accordingly, it can be said that it is desirable to increase the additive amount of cashew nut shell liquid or a derivative thereof as much as possible within the range as mentioned above.

Furthermore, in proportion to cashew nuts shell liquid increased, the occurence of "Crack" at the time of machining V-shaped grooves has decreased. "Crack" has not occurred at all in the Examples 4 and 5 due to the long-chained structure possessed by cashew nut shell liquid.

The ratio of abrasives grain could be increased to 98% using a bonding agent containing cashew nut shell liquid.

According to the present invention, as described above, it is clear that the performance of an grinding wheel can be greatly increased by raising the filling ratio of abrasives grain more than 96% which is greater than the filling ratio of the conventional method.

As described above, the present invention has its effects that in order to give surface-wettability at the time of operation by adding further surface active agent to a bonding agent containing a reaction product of a resin and a solution of cashew nut shell liquid or its derivative, the abrasive performance is further improved, and in addition, various properties contained in the surface active agent are effectively made the best use for abrasive performance, whereby presenting a grinding wheel which can raise machining accuracy of the work to be finished and highten the washability of the surface of the work, and also has long life span.

What is claimed is:

1. A grinding wheel having a bonding agent for binding abrasive grains, comprising a reaction product of a synthetic resin and cashew nut shell liquid or its derivative.

2. The grinding wheel of claim 1, wherein the filling ratio of cashew nut shell liquid in the grinding wheel is 0.4% to 2.4%.

3. The grinding wheel of claim 1, wherein the filling ratio of abrasive grain is from 96 to 98%.

4. The grinding wheel as claimed in claim 1, wherein the bonding agent further comprises a surface active agent.

5. The grinding wheel of claim 1, wherein the filling ratio of cashew nut shell liquid in the grinding wheel is from 1.6 to 2.4%.

6. The grinding wheel of claim 1, wherein said synthetic resin is a phenol resin.

7. The grinding wheel of claim 6, wherein the filling ratio of cashew nut shell liquid in the grinding wheel is from 0.4% to 2.4%.

8. The grinding wheel of claim 6, wherein the filling ratio of cashew nut shell liquid is from 1.6% to 2.4%.

* * * * *